United States Patent [19]

Brodbeck

[11] 3,934,579

[45] Jan. 27, 1976

[54] MASSAGING AND RELAXING DEVICE

[76] Inventor: Brunhilde Brodbeck, 1440 Poplar Ave., Memphis, Tenn. 38104

[22] Filed: Oct. 4, 1974

[21] Appl. No.: 511,981

[52] U.S. Cl. ..... 128/57

[51] Int. Cl.[2] ..... A61H 15/00

[58] Field of Search ..... 128/57, 58, 24.3, 24.4, 128/67

[56] References Cited

UNITED STATES PATENTS

| | | | |
|---|---|---|---|
| 731,693 | 6/1903 | Lennox | 128/57 |
| 1,585,767 | 5/1926 | Clarke | 128/57 |

*Primary Examiner*—Lawrence W. Trapp

*Attorney, Agent, or Firm*—Hill, Gross, Simpson, Van Santen, Steadman, Chiara & Simpson

[57] ABSTRACT

Muscle toning apparatus that can be used by one or more individuals to tone the muscles of a single person as passed back and forth under varying pressures, to relieve and stimulate tired muscles.

2 Claims, 7 Drawing Figures

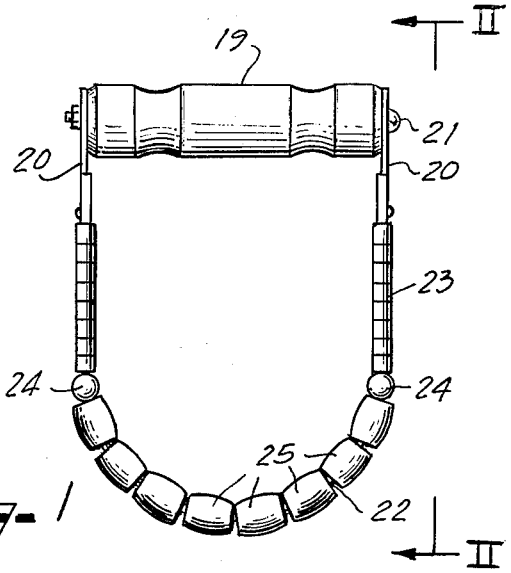
Fig. 1
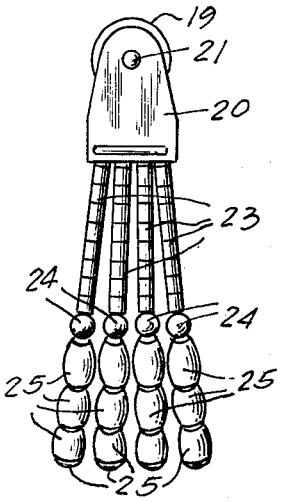
Fig. 2
Fig. 6
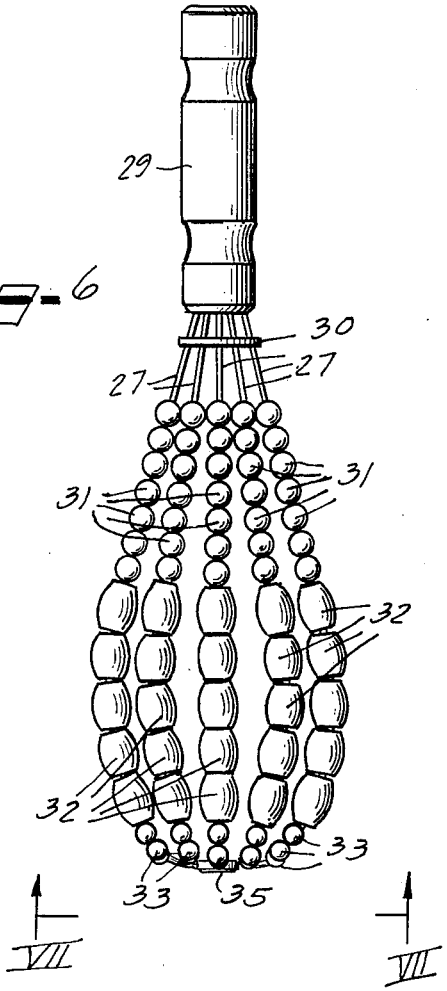
Fig. 7
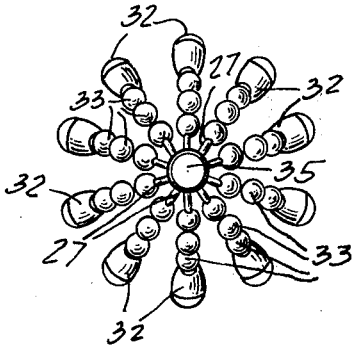

MASSAGING AND RELAXING DEVICE

BACKGROUND, SUMMARY AND ADVANTAGES OF INVENTION

Muscle toning apparatus have heretofore been generally disclosed in such patents as the U.S. Pat. Nos. to Rohrer 1,014,774, Clarke 1,585,767 and Belleville 2,578,916, which operate on the principle of relieving tissue and muscle tension as passed back and forth along the body. While some of these tension relievers are particularly made to generally conform to parts of the body, they are mostly stiff and unwieldy and do not perform an efficient massaging operation.

The present invention improves upon the massaging devices of the foregoing references by providing a relatively flexible, freely movable relaxer or exerciser, which may conform to various parts of the body and perform a muscle toning or relaxing function without discomfort to the body.

An advantage of the present invention is that the relaxer is sufficiently flexible and freely movable to relax the body tissues and relieve tension by a slow toning motion along the desired parts of the body.

A further advantage of the invention is that the massaging device may readily relieve tension from various parts of the body by exerting a free rolling motion along the tense muscular portions of the body.

A still further advantage of the invention is that the apparatus and its operation is so simple and requires so little physical effort that it may be operated by a confined person, such as a semi-invalid.

A still further advantage of the invention is the provision of an exercising apparatus and device producing a vigorous kneading motion, stimulating the skin and underlying tissues without damage to the skin and, at the same time, producing a soft and relaxing massaging action to dispel tension or fatigue.

Still another advantage of the invention is to massage on the principle of kneading or massaging with beads or rollers and to arrange the kneading or massaging rollers and support therefor to make it easy to manipulate the rollers over the throat, neck and sholder muscles and particularly at the base of the skull on the back of the neck.

A still further advantage of the invention is to provide a massaging device utilizing rotating beads to effect a massaging operation and to so size the beads as to avoid undesirable stretching of the skin and muscle tissue and to allow more pressure to be exerted where required over relatively long periods of time without discomfort.

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure.

DESCRIPTION OF THE DRAWINGS

FIG. 4 is a view in side elevation of another form of exercising device particularly adaptable for other extremities of the body than the device shown in FIG. 1;

FIG. 5 is a view in side elevation of the device shown in FIG. 4;

FIG. 6 is a view showing still another form in which the invention may be embodied; and FIG. 7 is an end view of the massager shown in FIG. 6, looking substantially along line VII—VII of FIG. 6.

DESCRIPTION OF THE PREFERRED EMBODIMENTS

Figure 1:
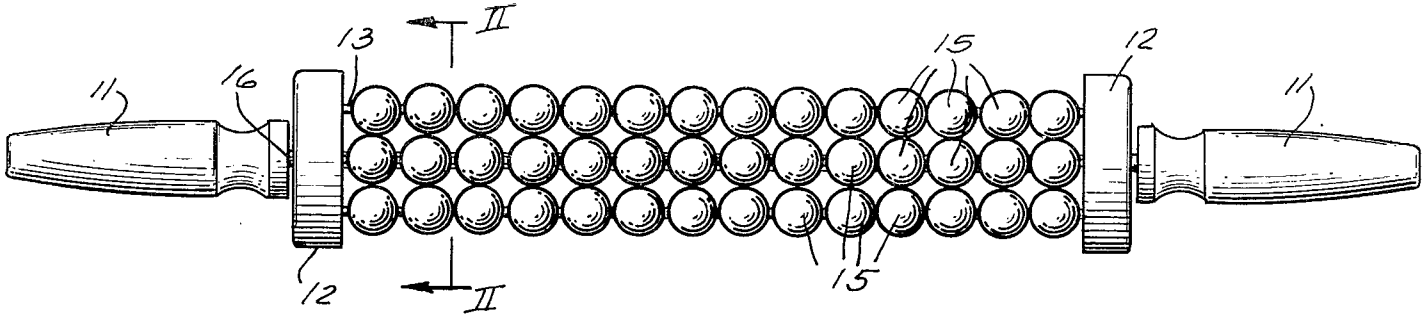
FIG. 1 is a diagrammatic view of a form of exerciser utilizing the principles of the present invention.

In the embodiment of the invention illustrated in FIG. 1 of the drawings, I have shown generally what may be termed a rolling-pin-type relaxer having handles 11 on each end of the relaxer on the outsides of disks 12 forming bearing supports for the handles and also forming supports for a series of parallel flexible pins 13 freely carrying massaging beads 15, shown as being balls, in side-by-side relation with respect to each other. While the massaging beads are shown as being generally spherical in form, it should be understood that they may be of various other forms suitable for particular massaging purposes.

The handles 11 are carried on opposite ends of a rod 16 rotatably journalled in the disks 12 on antifriction bearings 17. A finger of a hand grasping the handle 11 may hold the disk 12 and beads 15 from rotation about the axis of the rod 16, or may accommodate free rotatable movement of the disks 12 and massaging beads 15 to facilitate the massaging operation and reduce the effort required, as well as increase the areas of concentration of massage by enabling the pressure of the beads against the body to be varied without unduly increasing the pressure on the handles 11. It is, of course, understood that the beads 15 are always freely rotatable about the axes of the pins 13 except when the pressure may be great enough to frictionally engage the beads with each other as pressures on the handles 11 are varied. In most cases, however, it is advantageous that the beads freely rotate with respect to each other to reduce the strain of massaging.

It may, therefore, be understood that the massager or relaxing device just described can readily be used on any part of the body that can be reached, with as much or as little pressure required to do a thorough job and is particularly advantageous for massaging the abdominal regions of the body as well as the thighs.

Figure 3:
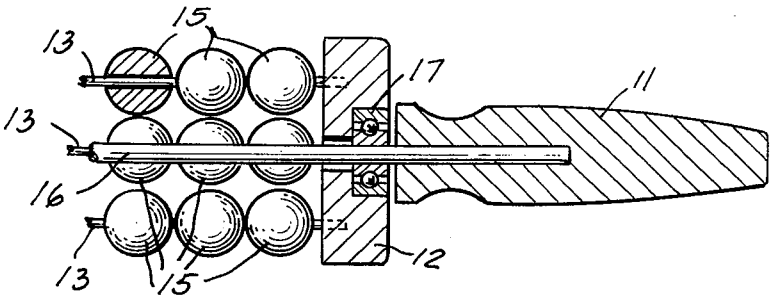
FIG. 3 is a fragmentary longitudinal sectional view of one end portion of the massaging device.
Figure 2:
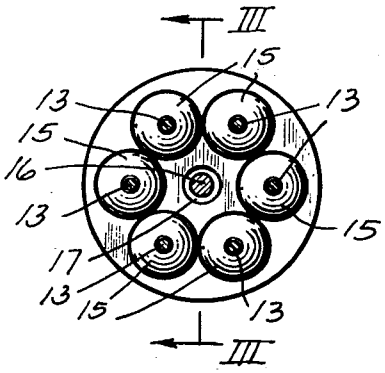
FIG. 2 is a sectional view taken substantially along line II—II of FIG. 1.

In FIG. 4 of the drawings, the massager is designed for readily relaxing and massaging parts that cannot easily be reached by the massager of FIGS. 1 through 3. The massager or muscle toner is particularly useful for reducing a double chin and tightening flabby muscles. It is also useful on the forehead from temple to temple, with a slow motion for relaxing the nerves and can be used in bed as a tranquilizer to help put a person to sleep, due not only to backward and forward motion of the massager over the forehead, but the slight rolling rhythm of the balls and beads. This form of the invention has a single handle 19 and may be said to be of a potato-masher-type. The handle 19 has brackets 20 secured to its opposite ends, as by a machine screw 21. The brackets 20 may be bent over a series of wires 22 crimped thereto and depending therefrom in the general form of a horse shoe and fan shape in side elevation. The wires 22 are shown as having a series of beads 23 strung thereon, generally cylindrical in form and terminating into lower bearing beads 24 of opposite ends of a series of elongated generally oval beads 25.

The rows of beads 23 and 25 are shown as flaring outwardly relative to the center of the machine screw 21 and also form an arc of their lower ends to provide a relaxer which may be rolled over various muscles and particularly adapted for use on the under and upper arm, to relax the muscles when tired. The device may be used above the elbow and from the wrist to the elbow for relaxing the arm muscles after heavy-duty work, and can readily be slipped over the ankle to relax the ankle and tired feet, particularly the soles of the feet after walking or standing. It further can also be used on the stomach or any muscle that can be reached, and is useful in rolling along the back of the neck between the shoulder blades and to be rolled over a patient when in a reclining position.

The relaxer of FIGS. 6 and 7 is generally in the form of a long oval similar to a beater and has a series of wires 27 extending from a handle 29 and terminating at their lower ends in a disk-like ring 30 also forming in appearance the general form of a food masher.

The wires 27 extend within the handle 29 and are connected together adjacent their upper ends beneath the handle 29 by a ring 30 extending about said wires to lend stability to the wires. Each wire has a series of graduated balls 31,32 and 33 freely mounted thereon to give a graduated relaxing or massaging effect as the apparatus is moved along the muscles of the body. The wires 27 terminate at their lower ends in a disk 35.

As shown in FIGS. 6 and 7, the balls 31 are round, although they need not be round, but may be of various desired forms, while the beads 32 are oval, but also may be of various desired forms which will give the best results during operation of the apparatus and for particular regions of the body.

This massager is useful for massaging and relaxing the neck as well as for reducing a double chin and tightening flabby muscles. It also may be used as a relaxer to induce sleep, like that shown in FIGS. 4 and 5.

In all of the relaxers shown, the multiple freely movable rollers act like gently rippling waves over sore muscles and particularly tired feet. The device just described may also readily be rolled over and under the arch and around the ankle, to increase circulation where the muscles have been overworked and are painful.

With the devices shown in FIGS. 4, 5 and 6, the larger beads at the end or arch of the device allow more pressure to be exerted in a massage effort to increase the kneading effect beneficial to the muscles, and particularly those enducing long periods of strain or fatique and the use of beads or rollers, rather than irregular devices having a tendency to roughen or tear up the skin, assures the avoidance of undesirable stretching of the skin and muscle tissue, which may be produced by improper massage manipulations and arrangements of other devices.

I claim as my invention:

1. A massaging and relaxing device for stimulating and relaxing various parts of the body having at least one hand grip and a plurality of beads extending from said hand grip, yieldable mounting means freely and flexibly mounting said beads for rotatable movement with respect to each other for contact with the body, comprising a series of flaring wires flaring outwardly from one end of said hand grip and converging toward their outer ends and turned inwardly as they approach their outer ends, and terminating at their outer ends at a relatively small diameter disk generally coaxial with said hand grip and connected to said disk in equally spaced radial relation with respect to each other, and said wires each having said beads freely mounted thereon and extending along greater portions of the length thereof.

2. The massaging and relaxing device of claim 1, in which the beads graduate in size from the hand grip to the end of the device with the larger beads adjacent the end of the device accommodating an increase in pressure in the massaging effort relative to the strength required for a kneading effect beneficial to muscles undergoing long periods of strain or fatigue.

* * * * *